US011181348B2

(12) United States Patent
Franklin et al.

(10) Patent No.: US 11,181,348 B2
(45) Date of Patent: Nov. 23, 2021

(54) BETLEY MAGNUM CARTRIDGE SYSTEM

(71) Applicant: Ballistic Innovations, LLC, Farmer City, IL (US)

(72) Inventors: Greg Franklin, Farmer City, IL (US); Chris Betley, Farmer City, IL (US)

(73) Assignee: Ballistic Innovations, LLC, Farmer City, IL (US)

( * ) Notice: Subject to any disclaimer, the term of this patent is extended or adjusted under 35 U.S.C. 154(b) by 0 days.

(21) Appl. No.: 16/238,629

(22) Filed: Jan. 3, 2019

(65) Prior Publication Data

US 2019/0204051 A1 Jul. 4, 2019

Related U.S. Application Data

(60) Provisional application No. 62/613,456, filed on Jan. 4, 2018.

(51) Int. Cl.
*F42B 5/02* (2006.01)
*F42B 5/34* (2006.01)
*F42B 33/10* (2006.01)

(52) U.S. Cl.
CPC ..... *F42B 5/34* (2013.01); *F42B 5/025* (2013.01); *F42B 33/10* (2013.01)

(58) Field of Classification Search
CPC .... F42B 5/00; F42B 5/02; F42B 5/025; F42B 5/08; F42B 5/26; F42B 5/28; F42B 5/285; F42B 5/30; F42B 5/307; F42B 5/34
USPC ..... 102/430, 439, 464, 465, 466, 467, 468, 102/469, 470, 471, 472; 86/19.5
See application file for complete search history.

(56) References Cited

U.S. PATENT DOCUMENTS 4,694,753 A * 9/1987 Thomas ..... C06B 25/24 102/289
6,293,203 B1 * 9/2001 Alexander ..... F42B 5/025 102/430
2006/0090664 A1 * 5/2006 Stock, Jr. ..... F42B 5/26 102/464
2009/0211483 A1 * 8/2009 Kramer ..... F42B 5/025 102/439
2011/0214583 A1 * 9/2011 Dutch ..... F42B 5/025 102/464

* cited by examiner

*Primary Examiner* — Jonathan C Weber
(74) *Attorney, Agent, or Firm* — K&L Gates LLP

(57) ABSTRACT

The present disclosure provides a cartridge that modifies the .223 cases to achieve a cartridge length of 38.3 mm for use with a bullet (e.g., 110 g). The present cartridge system allows the use of a 30-caliber bullet to be used in an AR15 rifle/pistol platform. The decreased cartridge length optimizes the powder burn rate and pressure, which in turn has a greater effect on the ballistics of the round. The present system yields 300-400 ft/s higher velocity over the .300 Blackout in rifle length barrels and greater than 500 ft/s in shorter pistol barrels.

8 Claims, 3 Drawing Sheets

| A | B | C | D | E | F | G | H |
|---|---|---|---|---|---|---|---|
| 38.3mm | 31.792mm | 30.595mm | 9.58mm | 8.484mm | 8.982mm | 9.161mm | 9.6mm |

| A | B | C | D | E | F | G | H |
|---|---|---|---|---|---|---|---|
| 38.3mm | 31.792mm | 30.595mm | 9.58mm | 8.484mm | 8.982mm | 9.161mm | 9.6mm |

BETLEY MAGNUM CARTRIDGE SYSTEM

CROSS-REFERENCE TO RELATED APPLICATIONS

This application incorporates by reference and claims the benefit of priority to U.S. Provisional Application 62/613,456 filed on Jan. 4, 2018.

BACKGROUND OF THE INVENTION

The present subject matter relates generally to bullet cartridges for 0.300 caliber rifles and pistols for hunting, self-defense, military, and law enforcement purposes.

Most domestic law enforcement agencies in the United States utilize the AR15/M16 rifle platform in the course of their daily duties, as patrol officers out on the street; it is often referred to as a "patrol carbine" and is carried by individual officers. These rifles are also used by SWAT teams for room entry or close quarter's battle (CQB) for close in shooting, and are used by some departments as short range sniper rifles. The reasons for the selection of this rifle platform are that they are readily available in many configurations and are fairly reasonably priced to Law Enforcement agencies, the AR15's weight and size are also attractive features of the AR15 as they are easily operable by large men and smaller stature women.

Even with the proper selection of ammunition, the 223 Remington is still substandard for most law enforcement applications and has a well known reputation for "over penetration" with its small-fast bullet. This can result in extremely dangerous situations for patrol officers working in a built up urban environment. The small weight or mass of the bullet makes it less effective and more prone to deflection on vehicles when engaged by police, especially when engaging thick windshield glass. Although there are a few "alternate" cartridges available that will function in the AR15 rifle, they do not offer enough of an improvement over the existing .223 Remington cartridge chambering to justify the cost in switching over to them, mainly cost and availability of ammunition and magazines. Thus, the agencies are limited on their choices of cartridge choices if they maintain the AR15/M16 rifle platform as their weapon of choice.

The other choice for law enforcement agencies is the larger and more costly AR15 and/or AR10 "style" rifle. For example, the AR15 is designed to shoot the .223/5.56 cartridge, wherein the AR10 shoots the .308. The AR15 and AR10 are almost identical in design and style. The rifles are made by various companies that fire the .308 Winchester cartridge. The .308 Winchester is a powerful cartridge and offers a substantial improvement over the much smaller .223 Remington chambering. Most police sniper rifles are chambered in the .308 Winchester and are bolt action guns, which do not allow for quick follow up shots if needed.

When quick follow up shots are required the larger AR15/AR10 style rifles are sometimes used, they are heavier and have more recoil than the smaller rifles, but deliver ample firepower when needed. These heavier and larger rifles are not the preferred option for SWAT teams for use in room entry and building clearing operations because the power of the 308 Winchester is too much for inside building operations, due to muzzle blast, recoil, and over penetration.

These two calibers represent not only the two most popular calibers used in law enforcement but are the two extremes, with the 223 Remington not providing enough performance or power and the 308 Winchester providing too much or excessive power.

The existing standard cartridge or chambering for the military's M16 rifle is the .223 Remington or 5.56 mm NATO (military designation) cartridge. It fires a .224 caliber bullet weighing 62 grains in the military issue M855 ammunition. Bullets weighing as much as 77 grains are currently in use by the US military to increase the performance of the 5.56 mm NATO cartridge and have increased the terminal performance of the cartridge, but its terminal effects are still less than desirable for what is considered an adequate combat cartridge. The shortcomings in the performance of the 5.56 mm NATO cartridge are well documented in current and past military conflicts, and the cartridge's ineffectiveness is more pronounced when the enemy combatants are under the influence of drugs that affect the central nervous system.

An alternative for heavier machine guns is the .308 or 7.62 mm caliber bullet. The most common military caliber utilizing the .308 or 7.62 mm caliber bullet is the 308 Winchester or 7.62 mm NATO cartridge. The performance of the 7.62 NATO is also well documented in combat and is known for its increased stopping power. The U.S. M14 rifle fires the 7.62 mm NATO cartridge as does the U.S. M240 machinegun, as well as several aircraft mounted machineguns and the mini-gun. The AK47 also utilizes a 7.62 mm bullet.

What is needed is a cartridge that will provide improved stopping power without over penetrating, and is compatible with the standard size M16/AR15 rifle platform.

The .300 Winchester Magnum (also known as .300 Win Mag or 300WM) (7.62×67 mm) is a belted, bottlenecked magnum rifle cartridge that was introduced by Winchester Repeating Arms Company in 1963. The .300 Winchester Magnum is a magnum cartridge designed to fit in a standard rifle action. It is based on the .375 H&H Magnum, which has been blown out, shortened, and necked down to accept a .30 caliber (7.62 mm) bullet The .300 AAC Blackout and 300 ACC Blackout (which is identical to the 300 Whisper), also known as 7.62×35 mm, is a rifle cartridge for use in M4 carbines. Its purpose is to achieve ballistics similar to the 7.62×39 mm Soviet cartridge in an AR-15 while using standard AR-15 magazines at their normal capacity. The 300 Blackout should not be used in a rifle chambered for .223/5.56 or 7.62×40 mm.

The 300 Super has problems with smaller 110 grain bullets. Smaller bullets are shorter and as a result, the smaller bullets seat very shallow in the case making ramp clearances inconsistent, which adversely effects accuracy and precision. Further, the 300 Blackouts ballistic energy is lacking for longer range rifle shooting. For example, a 500 yard target for a .300 Blackout is an extremely difficult target because of bullet drop caused by a lack of energy.

What is needed is a cartridge that will provide improved stopping power without over penetrating, and is compatible with the standard size rifle and pistol platform.

BRIEF SUMMARY OF THE INVENTION

The present disclosure provides a modified cartridge system. Various examples of the system are provided herein.

Specifically, the present disclosure provides a cartridge that modifies the .223 cases, which has a length of 45 mm, by trimming the case length to 38.3 mm. Alternatively, the present system can add 0.2 mm-0.4 mm (e.g., 0.3 mm) to a 38 mm cartridge, such as the 300 Super cartridge The present 38.1-38.5 mm (e.g., 38.3 mm) cartridge length to allow the bullet (e.g., 110 g bullet) to sit deeper in the cartridge case. As a result, the change in the length causes a change in the powder to space ratio, which ultimately advantageously effects the performance.

The present cartridge system allows the use of a 30 caliber bullet to be used in an AR15 rifle/pistol platform. The decreased cartridge length optimizes the powder burn rate and pressure, which in turn has a greater effect on the ballistics of the round. The present system yields 300-400 ft/s higher velocity over the .300 Blackout in rifle length barrels and greater than 500 ft/s in shorter pistol barrels.

An advantage of the present cartridge system is the ability to be used in a pistol length barrel of seven inches, a gun size used by the police and military, a barrel length which is easier for the police and military to enter and exit the vehicle. Although, the present cartridge can be used with any 7-18 inch barrels.

A further advantage of the present cartridge system is attaining a velocity of 2335 ft/s using a 135 grain bullet in a 7 inch (e.g., 7 inch, 7 and ¼ inch, and 7 and ½ inch) barrel, as compared to the conventional 300 Blackout that only achieves a velocity of 1800 ft/s. As a result of the improved velocity, the present system provides a more versatile cartridge system that can allow for the of a single weapon for both short range and long range shooting. Therefore, the police and military will no longer need to carry two separate guns for different shooting distances, but rather can use a single gun for both needs.

Another advantage of the present cartridge system is that can be used for shooting subsonic loads which allows for police and military to use suppressors when maintaining stealth activity, as well as supersonic loads for longer range targets.

Another advantage of the present cartridge system is that when using subsonic loads and 110 grain bullets. Swat teams can use stealth in certain situations making the subsonic loads important. The 110-grain bullet typically does not function well at subsonic speed, thus a 220-grain bullet is used instead.

Further, a cartridge system functional for a 110-grain bullet offers the advantage of not penetrating two layers of drywall common in most homes and buildings, which makes it less likely of inadvertently hitting non-targeted civilians in a close quarter incursions.

A further advantage of the present cartridge system is the ease of conversion from an AR15 rifle/pistol platform by replacing the current barrel with a barrel chambered for the present cartridge system. For example, the system can include a simple barrel change on an AR15 that is reliable for use with standard 5.56/.223 (AR15) magazines and bolt groups. In an example, the barrel can be as short as 7 inches.

Another advantage of the cartridge system includes the improved power required to reach long range targets by maintaining supersonic speed for up to 800 yards with certain bullet weights.

An advantage of the present cartridge system is that the present system has less recoil than .223, 5.56, 7.62×39, or .308 calibers. The decreased recoil is particularly unexpected in light of the tremendous power of the present round as it maintains supersonic speed at 800 yards using a 150 grain bullet.

Additional objects, advantages and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing figures depict one or more implementations in accord with the present concepts, by way of example only, not by way of limitations. In the figures, like reference numerals refer to the same or similar elements.

FIGS. 2A-2B is a schematic of an example of present cartridge system, wherein FIG. 2B is a table of measurements corresponding to the variables in FIG. 2A.

DETAILED DESCRIPTION OF THE INVENTION

The present disclosure includes a rifle cartridge. A cartridge is a type of ammunition packaging a projectile (e.g., bullet, shots, among others), a propellant substance (e.g., smokeless powder, black powder, among others), and a primer within a case (e.g., metallic, paper, plastic) that is made to fit within a barrel chamber of a firearm.

Figure 1:
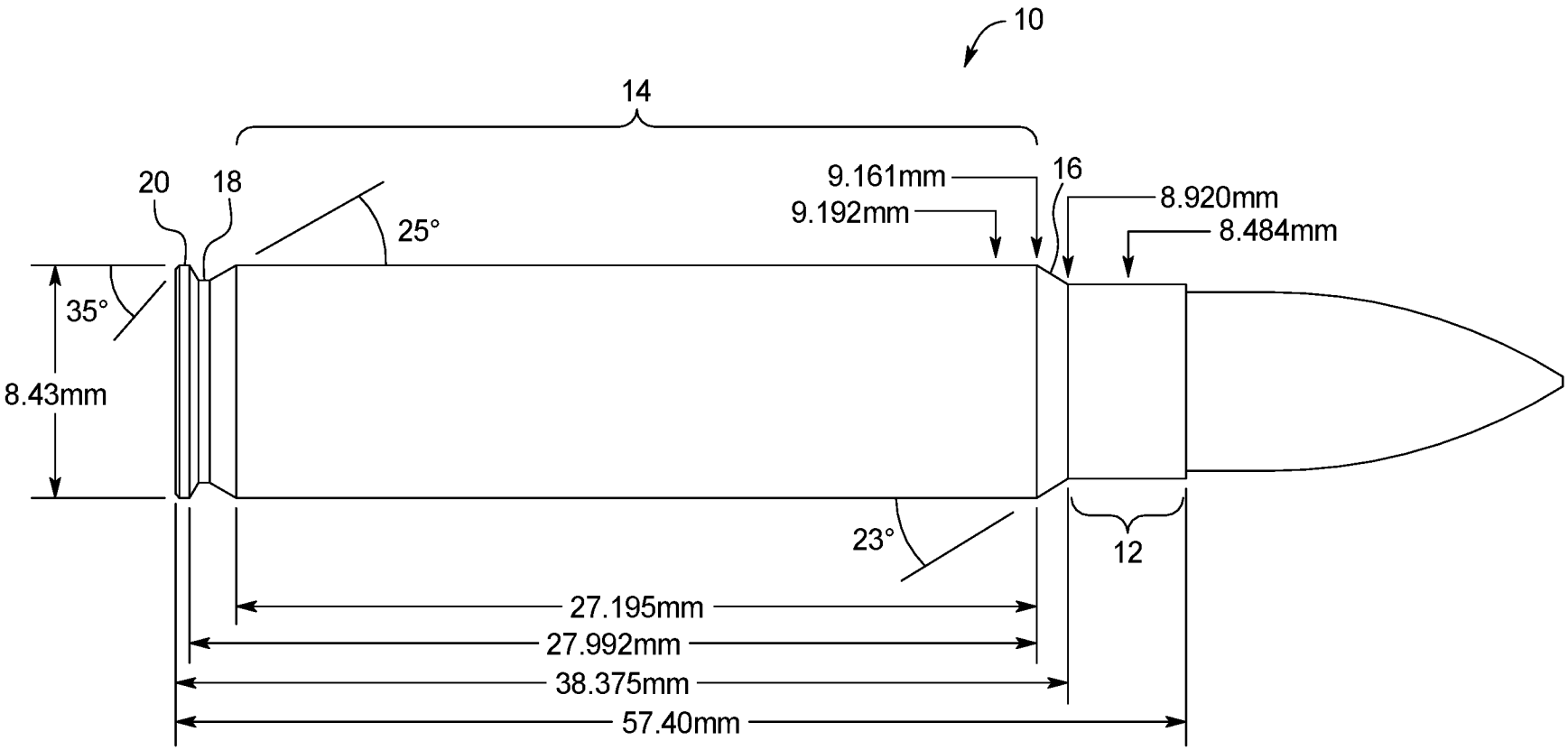
FIG. 1 is a schematic of an example of present cartridge system.
Figures 2A, 2B:
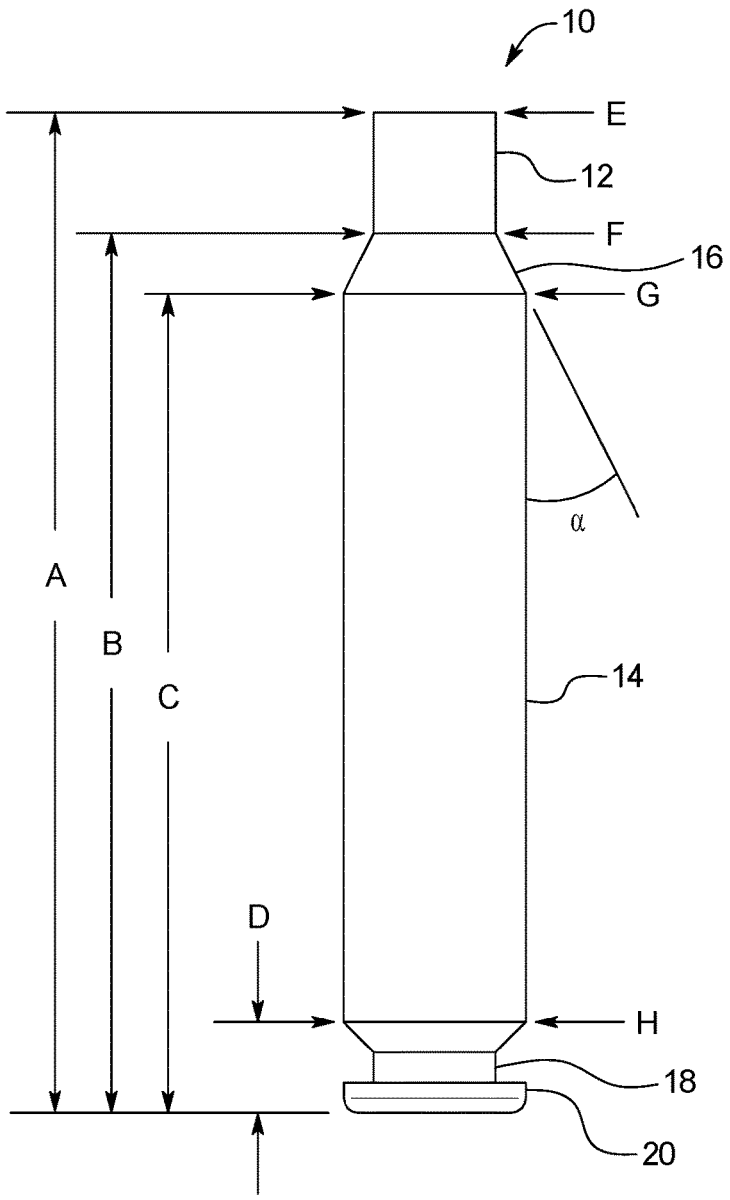

As shown in FIGS. 1-2B, the modified cartridge 10 includes a case including a neck portion 12, a body portion 14, and a base portion 20. In an example, the neck portion 12 can include a taper, wherein the neck portion expands from a neck first end (E in FIG. 2A) to a neck second end (F in FIG. 2A), wherein the neck second end is adjacent to the shoulder portion 16. In an example, the neck diameter of the neck portion 12 can expand from 8.484 mm to 8.982 mm.

The cartridge 10 can include a shoulder portion 16 joining the neck portion 12 to the body portion 14, wherein the shoulder portion 16 widens the diameter of the case from between 8.2 mm and 9.3 mm. For example, the shoulder 16 can expand the diameter from 8.484 mm to 9.192 mm, 8.8 mm to 9.2 mm, and/or from 8.982 mm to 9.161 mm. In an example, the shoulder 16 can include a shoulder first end (F in FIG. 2A) and a shoulder second end (G in FIG. 2A), wherein the shoulder first end can have a diameter of 8.920 mm and the shoulder second end can have a diameter of 9.161 mm. In an example, the shoulder first end includes a diameter of 8.982 mm and the shoulder second end can have a diameter of 9.161 mm.

The cartridge 10 can have a case length (A in FIG. 2A) between 38.0 mm to 39.0 mm, 38.25 mm to 38.35 mm, e.g., 38.3 mm.

The body portion 14 can include a taper in diameter. In an example, a body first end of the body portion of the case can have a diameter of 9.161 (G in FIG. 2A) to a body second end (H in FIG. 2A) can have a diameter of 9.6 mm. In an example, the body first end can have a diameter of 9.192 mm and the second end of the body portion close to the base of the cartridge can have a diameter of 9.548 mm. As such, the body portion of the case slightly tapers from the base of the case to the first end of the case body.

The case diameter at the base 20 (i.e., base diameter) can be between, and including, 9.0 and 9.8 mm, between 8.43 mm to 9.60 mm, for example, 9.6 mm, 9.55 mm. In an example, the case can include a base diameter substantially similar to a base diameter of the .223 Remington or the 5.56 mm NATO cartridge.

In an example, the cartridge is a rimless, bottleneck. The bullet diameter can be 0.308 in (7.8 mm), the neck diameter can be 0.334 in (8.5 mm), the base diameter can be 0.376 in (9.6 mm), the rim diameter can be 0.378 in (9.6 mm). The length of the case can be 1.508 in (38.3 mm). The maximum average pressure for the cartridge can be 379.2 MPa (55,000 psi).

With respect to the headspace in a cartridge, with a rimmed cartridge the headspace is at the top of the rim where the cartridge sits in the chamber. With a rimless bottleneck cartridge, the case of the cartridge is actually tapered ever so slightly from the bottom of the case to just below where the neck begins and so the entire case seats against the chamber and this is where the headspace is measured. Therefore, the headspace tolerance can be very tight, less than .002 inches.

In an example, the base portion 20 of the case body can connect to the body portion 14 via an indentation 18. The indentation 18 can be at an angle between 25-26°, wherein the indentation angle is measured from a longitudinal axis of the case body. The diameter of the base portion can be between, and including, 8.43 mm to 9.7 mm, for example, 8.43 mm, 8.48 mm, 9.60 mm, or 9.85 mm.

In an example, the present cartridge can be formed by modifying the 300 Blackout/Whisper from 35 mm to 38.3 mm, or the 300 Super from 38 mm to 38.3 mm, wherein the original case length of 45 mm of the .223 is shortened to 38.3 mm.

In an example, the rifle cartridge includes a brass case and a lead and copper bullet. The system can include a primer, such as a cupped piece of tin, that explodes when it is struck and smokeless powder that burns at different rates depends on the powder chosen. The case is commonly made of brass because it is resistant to corrosion. The brass case head can be work-hardened to withstand the high pressures of cartridges, and allow for manipulation via extraction and ejection without tearing the metal.

In an example, the cartridge can be used with any appropriate bullet. In an example, the bullet weight can be from 110 g to 240 g. The maximum cup pressure can be 55,000 psi.

The present disclosure focuses on the use of the cartridge system using an AR15 owing to the AR15's popularity with military, law enforcement, and hunters. However, the present cartridge system can be used in any legally made rifle or pistol that has a barrel chambered for the present cartridge, e.g., an AR15 rifle or pistol. The present cartridge can work in any configuration such as a bolt action, auto-loading, lever action, a hinged single shot, or even a revolver.

The cartridge system can be used with a modified barrel. A barrel can be modified using a rough reamer and a finish reamer. The barrel can be mounted in a lathe, as the lathe spins the barrel, the reamer can be inserted to drill out the chamber. A go/no go gauge can be used for precision.

The present cartridge system can be used in a small light weight rifle that can be maneuvered in tight places (e.g., cars) for both short and long range shots that would normally require a larger, heavier rifle and larger, heavier ammunition. As a result, only one rifle is necessary, instead of two separate rifles, one for short range and one for long range. For example, conventionally, one would need a .308 caliber rifle for long range shots that require an AR10 platform, which is much heavier and has more recoil. A second rifle is required conventionally with a pistol length barrel and subsonic loads for short range situations, which is why the 300 Blackout was developed. With the present system, one can use a single rifle with a short barrel for both subsonic and supersonic loads, and use a single ammunition type with half the weight and 30% less bulk.

In an example, the system can include a modified .223 cartridge. The length of the .223 case can be reduced from 45 mm to 38.3 mm. The neck of the .223 cartridge can be resized to fit the 30 caliber bullet, which is then loaded into the empty case with new primer, powder, and bullet using a reloading machine. In an example, the system includes manufacturing the present cartridge without modifying an existing cartridge.

The present system can include .223 brass instead of 5.56 brass, wherein the .223 brass results in a more reliable cartridge system. In an example, the system includes H110 powder and 1680 powder in combination with .223 brass. In an example, for heavier bullets over 200 g, the 1680 powder is used. For bullets under 200 g, the H110 powder can be used.

The present cartridge system can include a bore diameter of 7.6 mm (0.300 inches) and a groove diameter of 7.8 mm (.308 in). The system can include a six-groove barrel with each groove being 2.8 mm (0.110 in) wide.

Figure 3:
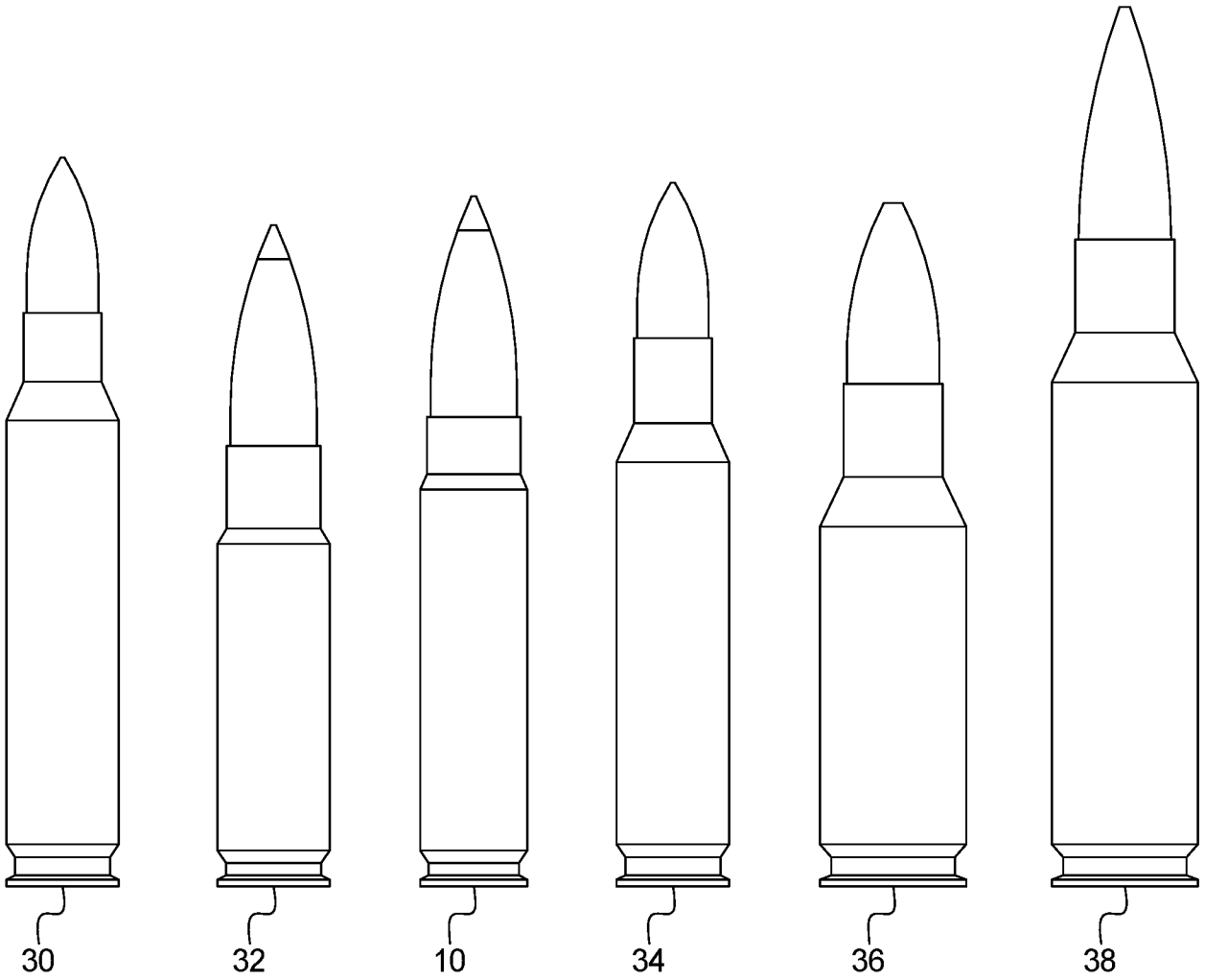
FIG. 3 is a photo of an example of the present cartridge system and a number of conventional cartridges.

FIG. 3 is a photo of the present cartridge system as well as a number of conventional bullet systems. From left to right, the bullets include: .223 Remington 30, 300 Blackout 32, 300 Betley Magnum (the present cartridge system) 10, 6.8 Remington spc 34, 30 Remington ar 36, and .308 Winchester 38.

In an example, in the present system, one can pull two pins on the rifle to remove the upper (the upper portion of the rifle including the chamber and barrel but not the trigger) and remove the 223/556 or even the Blackout and replace it with the upper chambered for the present 300 Betley Magnum in less than 60 seconds and very inexpensively depending on the quality of components being used for the new upper. Most military, police, and hunters use guns that have a trigger system wherein it is advantageous to be able to change the upper while leaving everything else the same including the magazines.

Examples

The present examples use two different chronographs to eliminate variability of the equipment. The data for the present cartridge is from an AR15 rifle having a 16" 5R barrel with 11:1 twist rifling. The data for the other cartridges came from the Hornady Handbook which is the source for ammunition ballistics.

TABLE 1

| Cartridge | Bullet Weight | Velocity |
|---|---|---|
| Whisper/Blackout | 135 g | 2000 ft/s |
| Whisper/Blackout | 155 g | 1800 ft/s |
| Whisper/Blackout | 195 g | 1500 ft/s |
| .308 | 135 g | 2900 ft/s |
| .308 | 155 g | 2600 ft/s |
| .308 | 195 g | 2300 ft/s |
| 300 Betley Magnum | 135 g | 2450 ft/s |
| 300 Betley Magnum | 155 g | 2400 ft/s |
| 300 Betley Magnum | 195 g | 1600 ft/s |
| 300 Betley Magnum | 110 g | 2335 ft/s (7" barrel) |

As seen from the results in Table 1, the present cartridge system (300 Betley Magnum) provides for greater velocity than that of the Whisper/Blackout cartridge for each bullet weight, respectively. The present cartridge system has a lesser velocity than that of the .308 cartridge.

As shown from the data, the present cartridge (300 Betley Magnum) has an advantage in its weight, bulk, ability to achieve subsonic speeds (and thereby suppress noise), and the ability to use short barrel guns.

It should be noted that various changes and modifications to the embodiments described herein will be apparent to those skilled in the art. Such changes and modifications may be made without departing from the spirit and scope of the present invention and without diminishing its attendant advantages. For example, various embodiments of the systems and methods may be provided based on various combinations of the features and functions from the subject matter provided herein.

We claim:

1. A rifle cartridge comprising:

a case having a case length, wherein the case includes a neck portion, a shoulder portion, a body portion, and a base portion;

wherein the shoulder portion joins the neck portion to the body portion and includes a first shoulder end adjacent to the neck portion having a diameter of about 8.48 mm and a second shoulder end adjacent to the body portion having a diameter of between, and including, 9.0 mm and 9.3 mm, wherein the case length is 38.3 mm, and wherein the base portion has a base diameter of 9.55 mm.

2. The rifle cartridge of claim 1, wherein the cartridge is compatible with an AR15 rifle.

3. The rifle cartridge of claim 1, wherein the cartridge is compatible with an AR10 rifle.

4. The rifle cartridge of claim 1, wherein the case houses a bullet, wherein the bullet has a diameter greater than 7.62 mm.

5. The rifle cartridge of claim 1, wherein the cartridge houses a 30 caliber bullet.

6. The rifle cartridge of claim 1, further comprising a gun powder including H110 powder, 1680 powder, or combinations thereof.

7. The rifle cartridge of claim 1, wherein the case includes brass.

8. The rifle cartridge of claim 1, wherein the base portion is rimless.

* * * * *